US012565733B2

(12) United States Patent
Guldan

(10) Patent No.: US 12,565,733 B2
(45) Date of Patent: Mar. 3, 2026

(54) DRYER VENT COUPLING ASSEMBLY

(71) Applicant: Michael Guldan, Massena, NY (US)

(72) Inventor: Michael Guldan, Massena, NY (US)

( * ) Notice: Subject to any disclaimer, the term of this patent is extended or adjusted under 35 U.S.C. 154(b) by 615 days.

(21) Appl. No.: 18/124,655

(22) Filed: Mar. 22, 2023

(65) Prior Publication Data

US 2024/0318372 A1 Sep. 26, 2024

(51) Int. Cl.
*D06F 58/10* (2006.01)
*D06F 58/20* (2006.01)
*D06F 58/22* (2006.01)

(52) U.S. Cl.
CPC ..... *D06F 58/10* (2013.01); *D06F 58/20* (2013.01); *D06F 58/22* (2013.01)

(58) Field of Classification Search
CPC ..... D06F 58/10; D06F 58/20; D06F 58/22; F16L 21/00; F16L 21/06; F16L 25/14; F16L 41/08; F16L 27/0816; F24F 13/0209
See application file for complete search history.

(56) References Cited

U.S. PATENT DOCUMENTS 5,970,623 A * 10/1999 Tuggle ..... D06F 58/20 34/235
6,370,794 B1 4/2002 Tuggle
7,240,930 B2 7/2007 Stravitz
9,227,095 B2 1/2016 Tamburro
9,689,108 B2 6/2017 Hamman
10,422,458 B2 9/2019 Smith
D873,989 S 1/2020 Jordan
2005/0052018 A1* 3/2005 Pichotta ..... F16L 37/004 285/9.1
2005/0184524 A1* 8/2005 Stravitz ..... F16L 21/002 285/903
2009/0133284 A1* 5/2009 Belgard ..... D06F 58/22 34/82
2011/0209353 A1* 9/2011 Goemans ..... D06F 58/22 34/82
2016/0327195 A1 11/2016 Johnson

FOREIGN PATENT DOCUMENTS

CA 2923711 9/2016
FR 2573174 A1 * 5/1986 ..... F16L 17/025

OTHER PUBLICATIONS

Translation FR-2573174-A1 (Year: 1986).*

* cited by examiner

*Primary Examiner* — Jessica Yuen

(57) ABSTRACT

A dryer vent coupling assembly includes a first sleeve which insertably receives an exhaust vent of a clothes dryer to receive heated air from the clothes dryer. The first sleeve has a set of first engagements and a set of second engagements. A filter has a pair of secondary engagements which each releasably engages a respective second engagement in the first sleeve for mounting the filter within the first sleeve to filter lint from the heated air. A second sleeve is insertable into the first sleeve and the second sleeve has a pair of secondary engagements which each releasably engage a respective one of the second engagements on the first sleeve for securing the second sleeve in the first sleeve. The second sleeve extends into an exhaust duct of a building to direct the heated air into the exhaust duct for venting the heated air from the building.

9 Claims, 7 Drawing Sheets

DRYER VENT COUPLING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dryer vent devices and more particularly pertains to a new dryer vent device for facilitating a quick disconnect connection between an exhaust vent of a clothes dryer and an exhaust duct. The device includes a first sleeve that insertably receives the exhaust vent of the clothes dryer. The first sleeve has a pair of first engagements and a pair of second engagements. The device includes a second sleeve that has a pair of primary engagements which each releasably engage a respective second engagement on the first sleeve. The second sleeve extends into an exhaust duct to vent the heated air into the exhaust duct.

(2) Description of Related Art Including Information Disclosed Under 37 CFR 1.97 and 1.98

The prior art relates to dryer vent devices including an elbow for coupling an exhaust duct between an exhaust vent of a clothes dryer. The prior art discloses a clamp designed to attaching tubular components together. The prior art discloses a dryer vent device that includes a box, a receiver integrated into the box, an exhaust duct attached to the box and a nozzle attached to an exhaust vent of a clothes dryer that extends into the receiver. The prior art discloses a connector that includes a first cylinder that is nestable into a second cylinder. The prior art discloses quick connect system for a vent hose that includes a nozzle which has slots in a neck of the nozzle and an exhaust duct that has tabs which slidably engage respective slots in the neck of the nozzle.

BRIEF SUMMARY OF THE INVENTION

An embodiment of the disclosure meets the needs presented above by generally comprising a first sleeve which insertably receives an exhaust vent of a clothes dryer to receive heated air from the clothes dryer. The first sleeve has a set of first engagements and a set of second engagements. A filter has a pair of secondary engagements which each releasably engages a respective second engagement in the first sleeve for mounting the filter within the first sleeve to filter lint from the heated air. A second sleeve is insertable into the first sleeve and the second sleeve has a pair of secondary engagements which each releasably engage a respective one of the second engagements on the first sleeve for securing the second sleeve in the first sleeve. The second sleeve extends into an exhaust duct of a building to direct the heated air into the exhaust duct for venting the heated air from the building.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
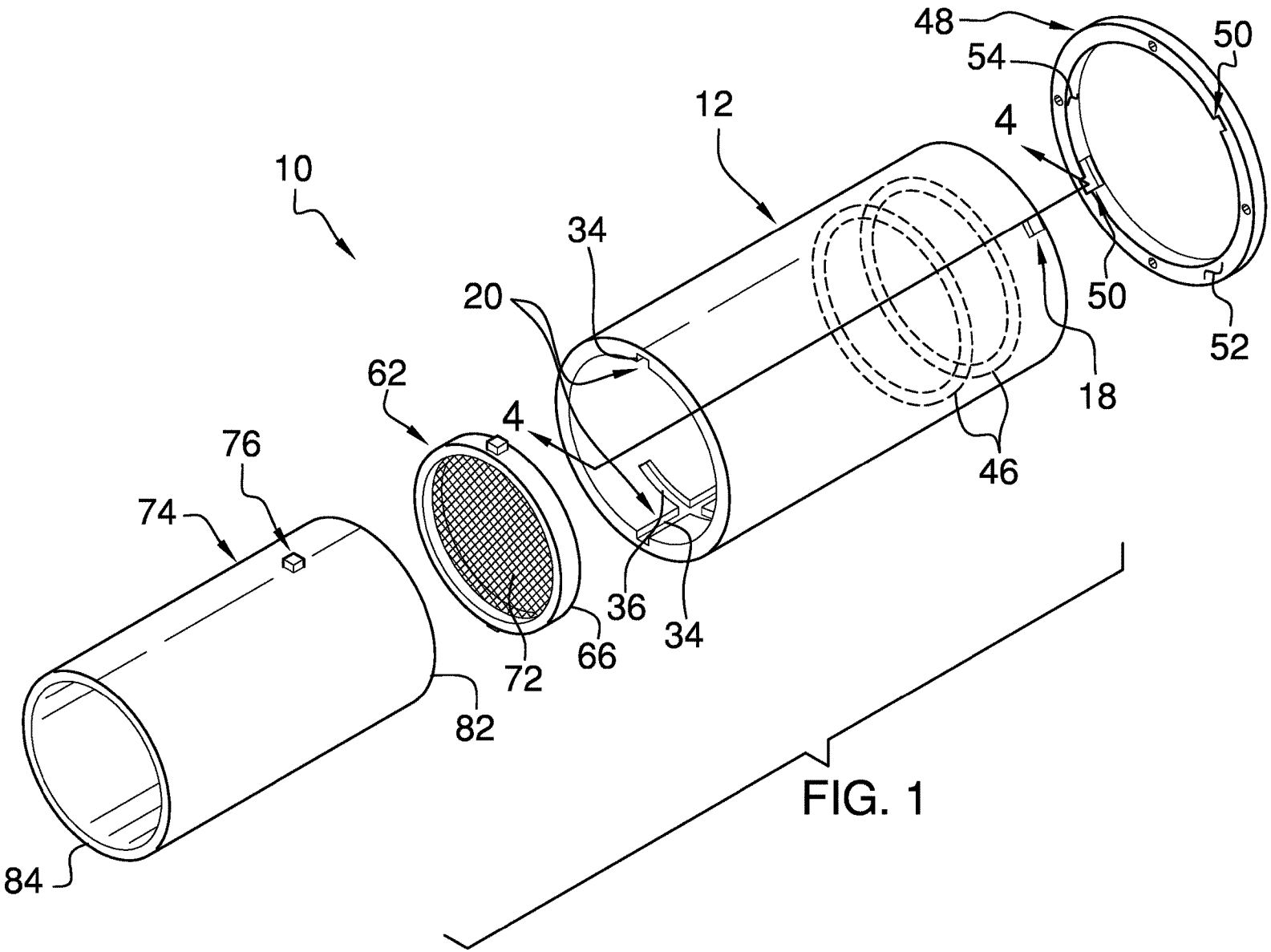
FIG. 1 is an exploded perspective view of a dryer vent coupling assembly according to an embodiment of the disclosure.
Figure 2:
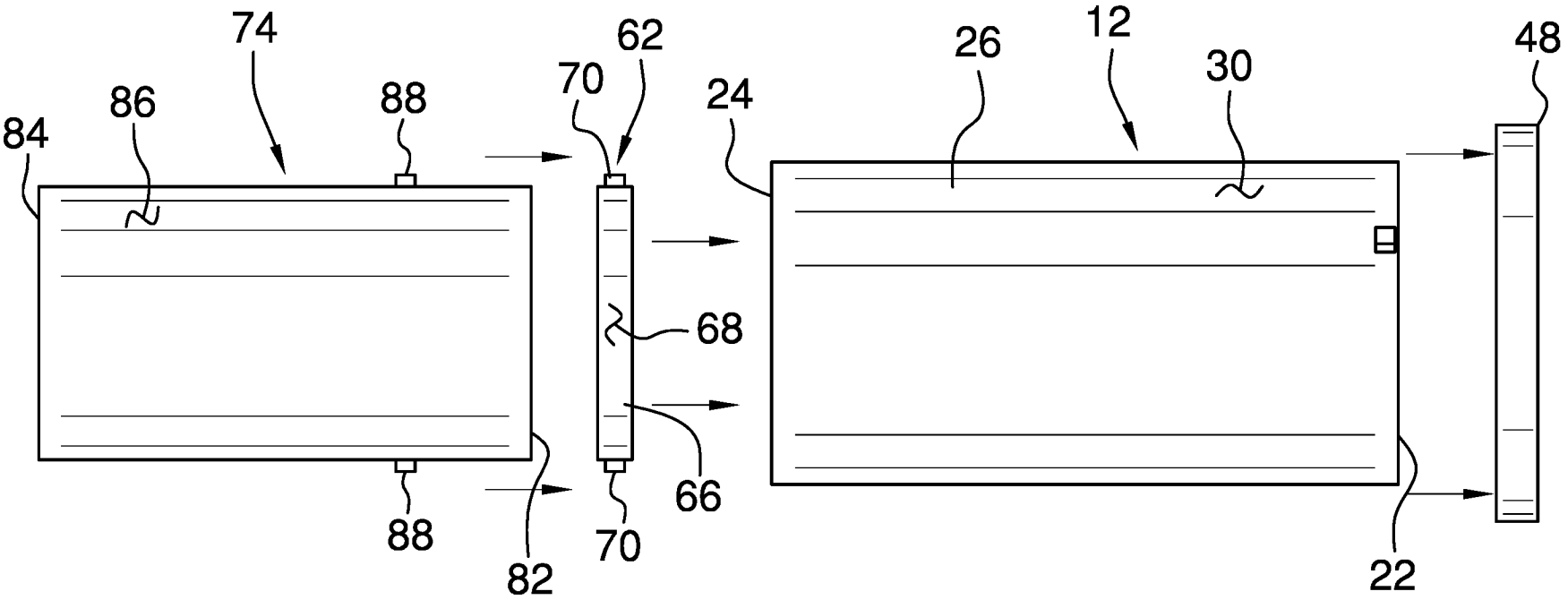
FIG. 2 is a left side exploded view of an embodiment of the disclosure.
Figure 3:
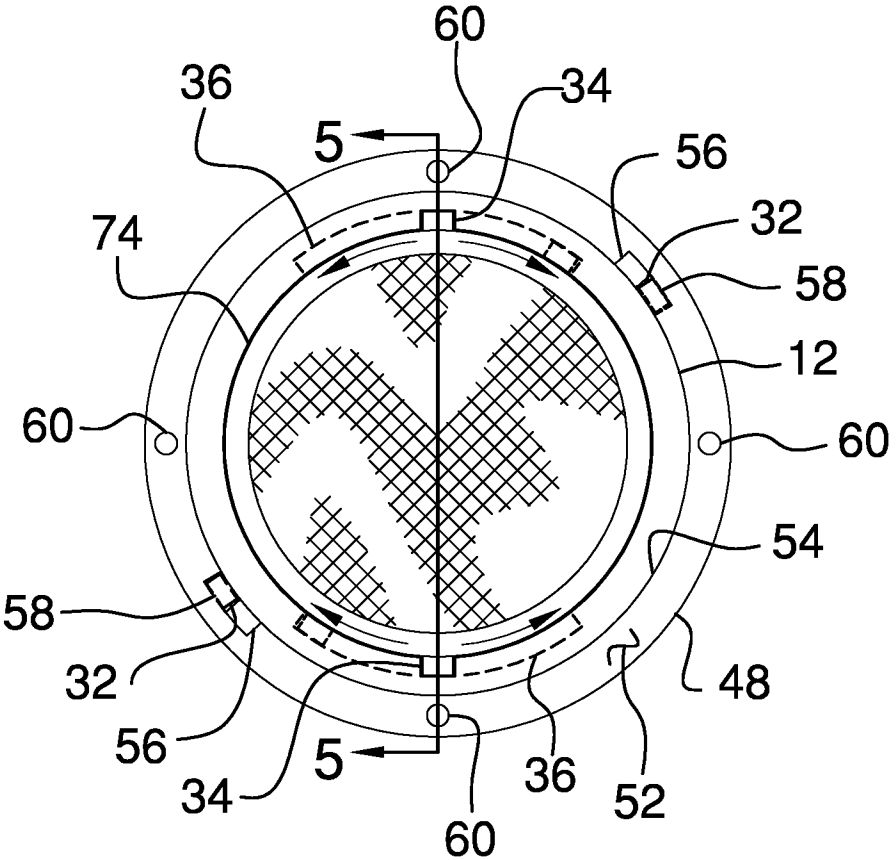
FIG. 3 is a front view of an embodiment of the disclosure.
Figure 4:
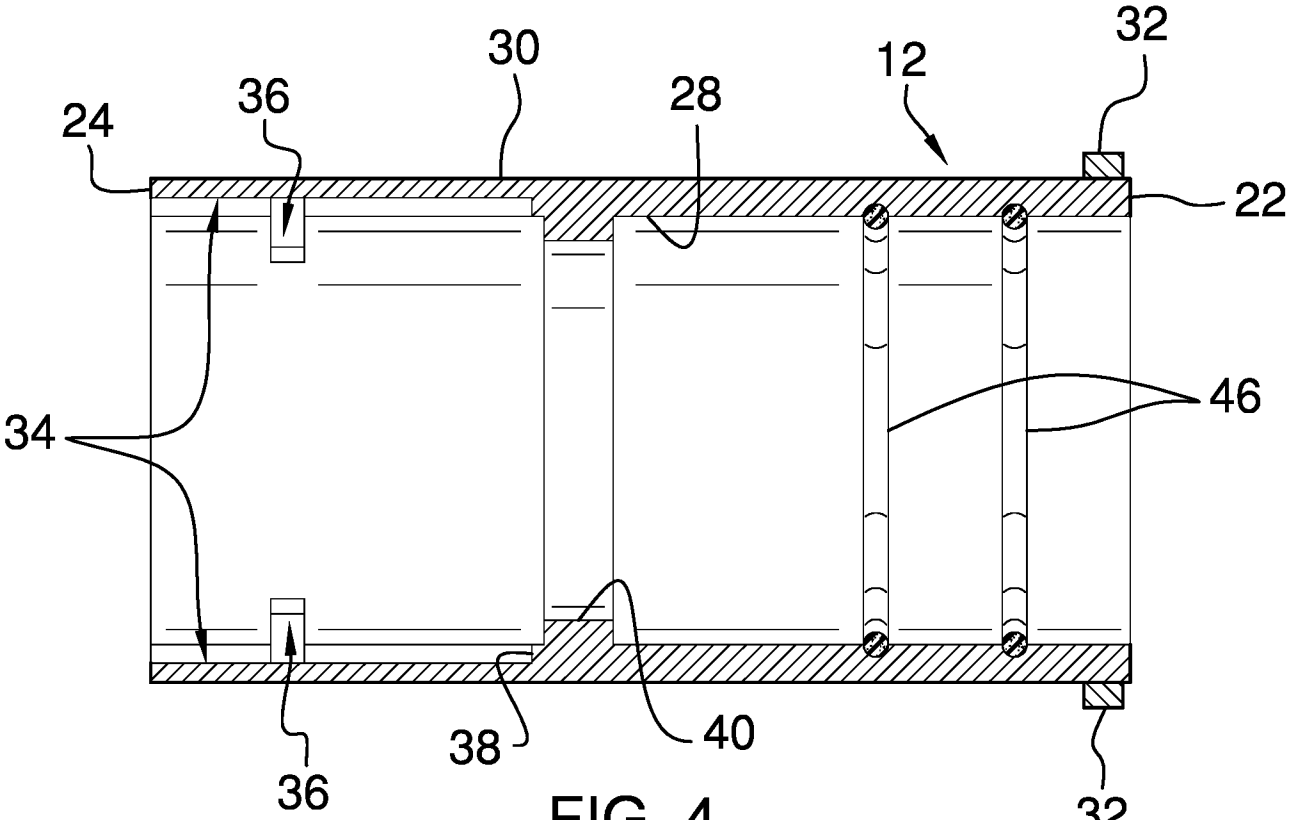
FIG. 4 is a cross sectional view taken along line 4-4 of FIG. 1 of an embodiment of the disclosure.

With reference now to the drawings, and in particular to FIGS. 1 through 7 thereof, a new dryer vent device embodying the principles and concepts of an embodiment of the disclosure and generally designated by the reference numeral 10 will be described.

As best illustrated in FIGS. 1 through 7, the dryer vent coupling assembly 10 generally comprises a first sleeve 12 has a diameter that is sufficient to insertably receive an exhaust vent 14 of a clothes dryer 16 such that the first sleeve 12 receives heated air from the clothes dryer 16. The clothes dryer 16 may be a clothes dryer of any conventional design, including but not being limited to an electric clothes dryer or a gas clothes dryer. The first sleeve 12 has a set of first engagements 18 and a set of second engagements 20. Additionally, the first sleeve 12 has a first end 22, a second end 24 and an outside wall 26 extending between the first end 22 and the second end 24 and the outside wall 26 has an inside surface 28 and an outside surface 30. The first sleeve 12 has a pair of tabs 32 each extending away from the outside surface 30 at a point located adjacent to the first end 22 such that the pair of tabs 32 defines the set of first engagements 18. Furthermore, the tabs 32 are positioned on opposing sides of the outside surface 30 with respect to each other.

The first sleeve 12 has a pair of first grooves 34 each extending into the inside surface 28 of the outside wall 26 and each of the first grooves 34 extends from the second end 24 of the first sleeve 12 toward the first end 22 of the first sleeve 12. Furthermore, the pair of first grooves 34 is positioned on opposing sides of the inside surface 28 with respect to each other. The first sleeve 12 has a pair of second grooves 36 each extending into the inside surface 28 of the outside wall 26 and each of the second grooves 36 is oriented to perpendicularly intersect a respective one of the first grooves 34; each of the first grooves 34 and the second grooves 36 defines the set of second engagements 20. Each of the second grooves 36 is positioned closer to the second end 24 of the first sleeve 12 than a terminal end 38 of the respective first groove. The first sleeve 12 has a lip 40 extending inwardly from the inside surface 28 of the outside wall 26 and the lip 40 is positioned adjacent to the terminal end 38 of the pair of first grooves 34. In an alternative embodiment 42 shown in FIG. 7, the first sleeve 12 may have a bend 44 located between the first end 22 and the second end 24.

A pair of gaskets 46 is provided and each of the gaskets 46 is integrated into the first sleeve 12 thereby facilitating each of the gaskets 46 to engage the exhaust vent 14 of the clothes dryer 16. In this way the pair of gaskets 46 inhibits air from leaking between the exhaust vent 14 of the clothes dryer 16 and the first sleeve 12. Each of the pair of gaskets 46 forms a closed ring extending around the inside surface 28 of the outside wall 26 of the first sleeve 12. The pair of gaskets 46 is evenly spaced apart from each other and the pair of gaskets 46 is positioned between the lip 40 and the first end 22 of the first sleeve 12. Each of the gaskets 46 may be comprised of a resiliently compressible material, including but not being limited to rubber or silicone.

A flange 48 is attachable to the clothes dryer 16 having the flange 48 extending around the exhaust vent 14. The flange 48 has a pair of primary engagements 50 which each releasably engages a respective one of the first engagements 18 on the first sleeve 12. In this way the first sleeve 12 is releasably attachable to the clothes dryer 16. The flange 48 has a forwardly facing surface 52 that is perpendicularly oriented with an inwardly facing surface 54. Additionally, the flange 48 has a pair of primary slots 56 each extending along the inwardly facing surface 54 and the pair of primary slots 56 is positioned on opposing sides of the inwardly facing surface 54 with respect to each other.

The flange 48 has a pair of secondary slots 58 each extending into the forwardly facing surface 52 and intersecting a respective one of the primary slots 56 such that each of the primary slots 56; the secondary slots 58 defines the respective primary engagement 50. Each of the tabs 32 associated with the first sleeve 12 is extendable into a respective one of the primary slots 56 to position the flange 48 around the first sleeve 12. The flange 48 is rotatable such that each of the tabs 32 travels into a respective one of the secondary slots 58 thereby locking the flange 48 on the first sleeve 12 for securing the first sleeve 12 to the clothes dryer 16. The flange 48 has a plurality of fastener holes 60 extending through the flange 48 to facilitate fasteners to extend through the fastener holes 60 and engage the clothes dryer 16 for mounting the flange 48 to the clothes dryer 16.

A filter 62 is included that has a pair of secondary engagements 64 which each releasably engages a respective one of the second engagements 20 in the first sleeve 12 for mounting the filter 62 within the first sleeve 12. In this way the filter 62 can filter lint from the heated air. The filter 62 includes a ring 66 which has an outwardly facing surface 68 and the ring 66 has a pair of tabs 70 each extending away from the outwardly facing surface 68. The filter 62 includes a screen 72 that is surrounded by the ring. Each of the tabs 70 on the outwardly facing surface 68 extends into a respective one of the first grooves 34 in the inside surface 28 of the outside wall 26 of the first sleeve 12 when the filter 62 is inserted into the second end 24 of the first sleeve 12. Furthermore, the filter 62 is urged into the first sleeve 12 such that each of the tabs 70 on the outwardly facing surface 68 abuts the terminal end 38 of the respective first groove 34.

A second sleeve 74 is insertable into the first sleeve 12 when the filter 62 is inserted into the first sleeve 12 such that the first sleeve 12 and the second sleeve 74 define a coupling unit 76. The second sleeve 74 has a pair of secondary engagements 76 which each releasably engages a respective one of the second engagements 20 on the first sleeve 12 for securing the second sleeve 74 in the first sleeve 12. Additionally, the second sleeve 74 has a diameter that is sufficient to extend into an exhaust duct 78 of a building 80. In this way the second sleeve 74 can direct the heated air into the exhaust duct 78 for venting the heated air from the building 80.

The second sleeve 74 has a primary end 82, a secondary end 84 and an outer surface 86 extending between the primary end 82 and the secondary end 84. The second sleeve 74 has a pair of knobs 88 each extending away from the outer surface 86, each of the knobs 88 is positioned closer to the primary end 82 than the secondary end 84 and the knobs 88 are positioned on opposing sides of the outer surface 86 with respect to each other. Additionally, each of the knobs 88 extends into a respective one of the first grooves 34 in the inside surface 28 of the outside wall 26 of the first sleeve 12 when the primary end 82 of the second sleeve 74 is inserted into the second end 24 of the first sleeve 12. The second sleeve 74 is rotatable to facilitate each of the knobs 88 to travel into a respective one of the second grooves 36 in the inside surface 28 of the outside wall 26 of the first sleeve 12. In this way the second sleeve 74 is secured in the first sleeve 12 having the ring 66 associated with the filter 62 positioned between the primary end 82 of the second sleeve 74 and the lip 40 on the inside surface 28 of the outside wall 26 of the first sleeve 12.

Figure 5:
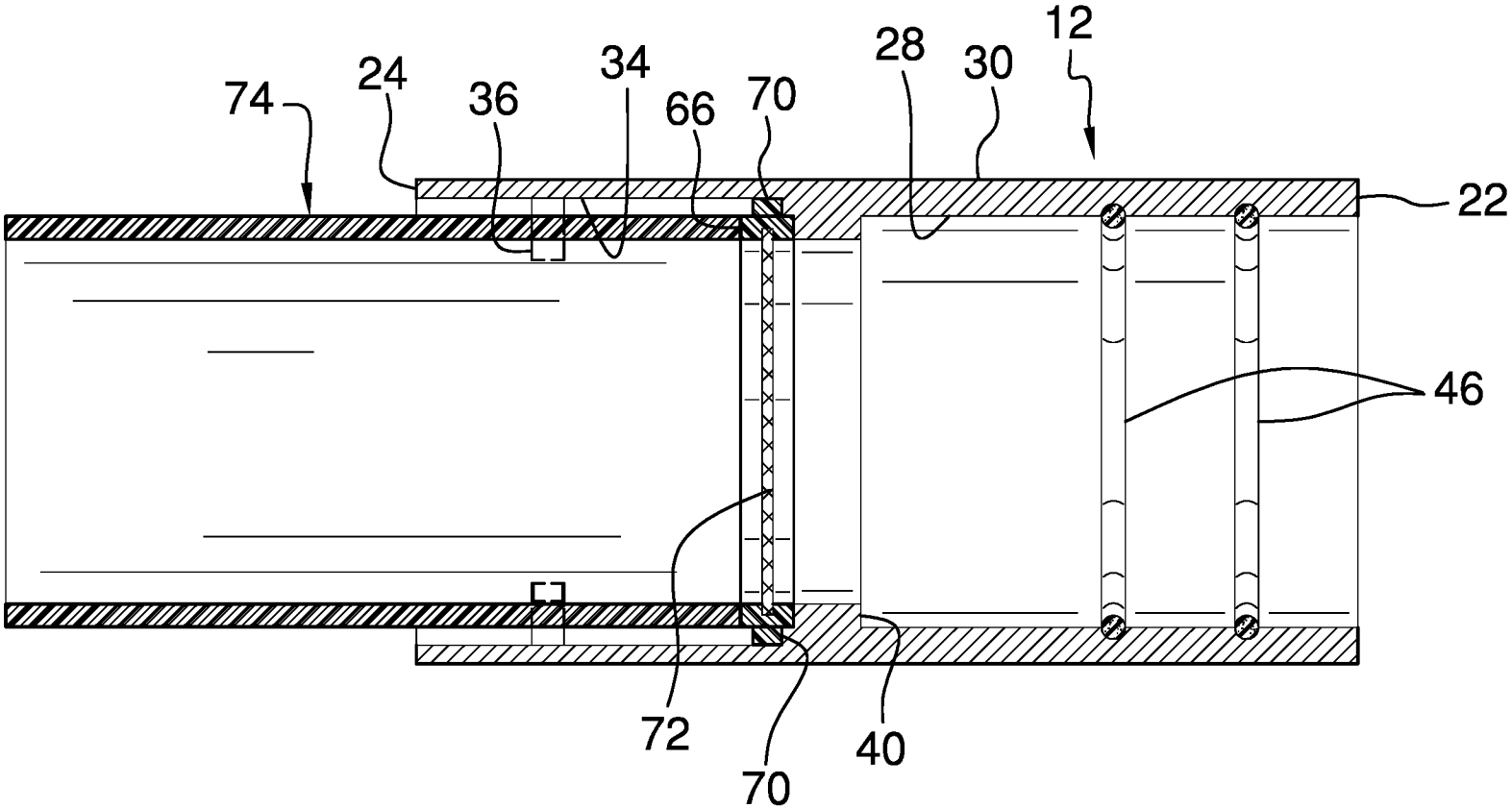
FIG. 5 is a cross sectional view taken along line 5-5 of FIG. 3 of an embodiment of the disclosure.
Figure 6:
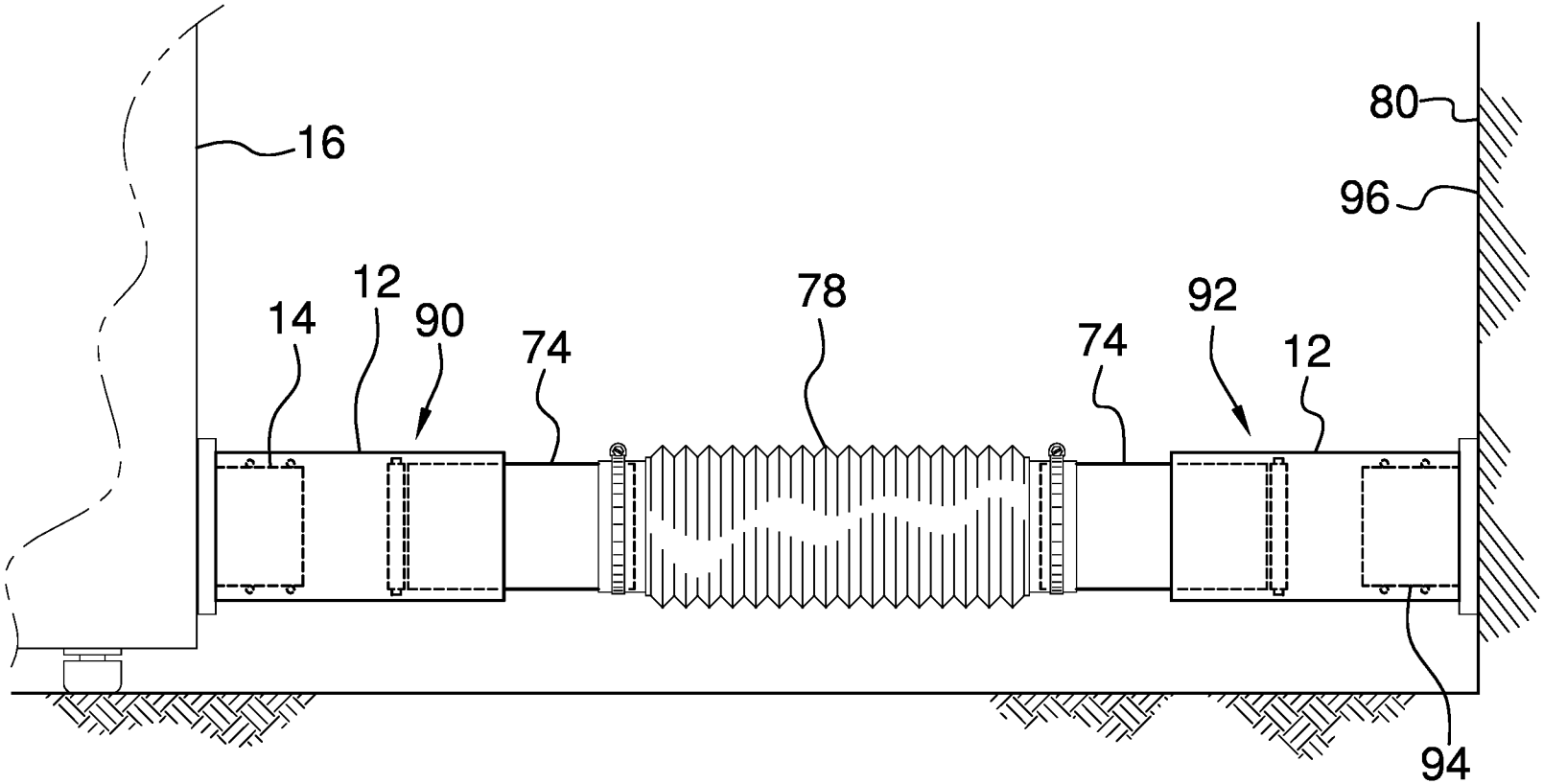
FIG. 6 is a perspective in-use view of an embodiment of the disclosure.
Figure 7:
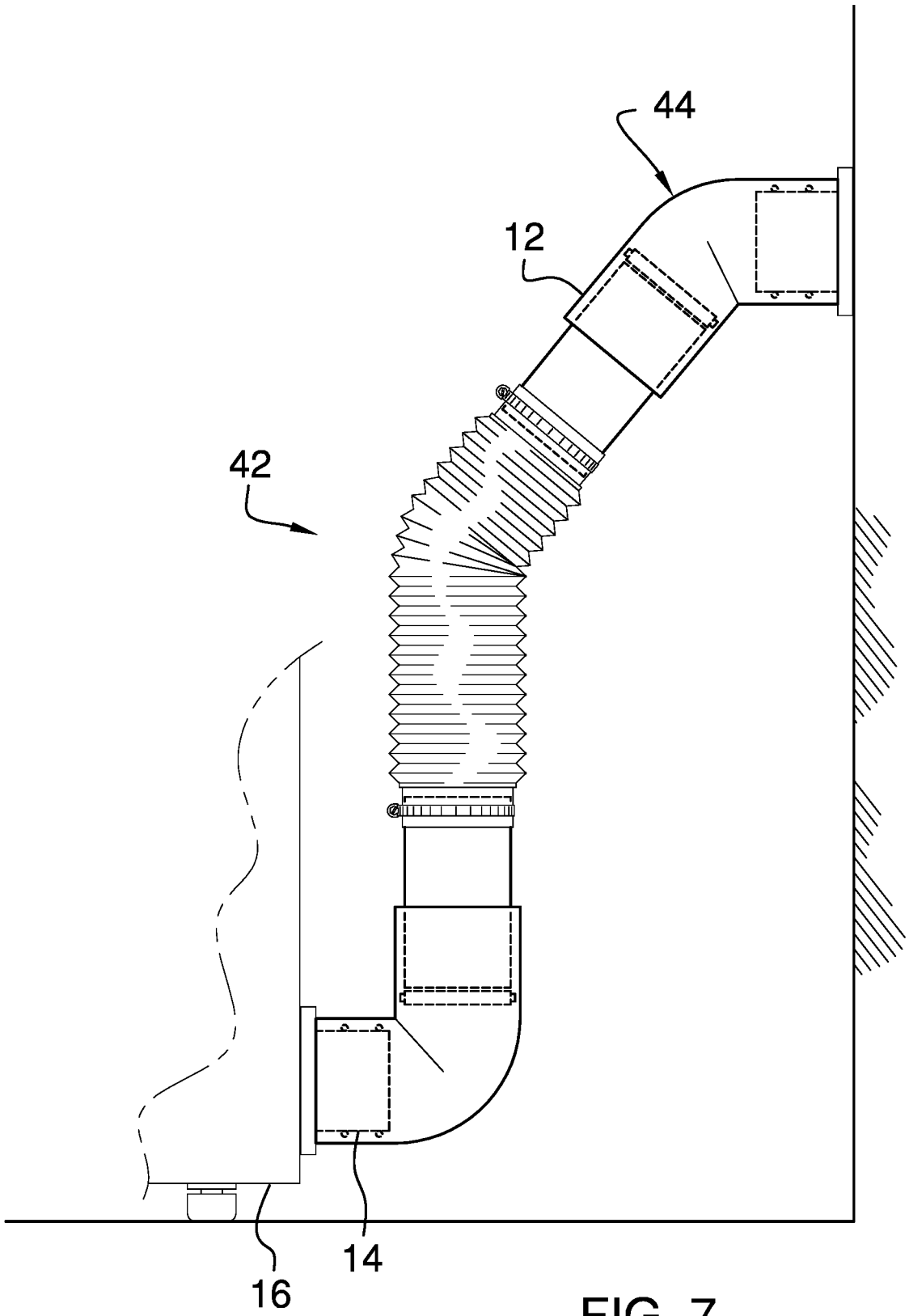
FIG. 7 is a perspective in-use view of an alternative embodiment of the disclosure.

In use, as is most clearly shown in FIG. 5, a pair of the coupling units 76 may be provided. The first sleeve 12 associated with a first one of the coupling units 90 may be attached to the exhaust vent 14 of the clothes dryer 16 and the first sleeve 12 associated with a second one of the pair of coupling units 92 may be attached to an exhaust vent 94 in an exterior wall 96 of the building 80. In this way the exhaust duct 78 can be attached to the second sleeve 74 associated with each of the first coupling unit 90 and the second coupling unit 92. Furthermore, the second sleeve 74 of the first coupling unit 90 can easily be detached from the first sleeve 12 of the first coupling unit 90 and the second sleeve 74 of the second coupling unit 92 can be easily detached from the first sleeve 12 of the second coupling unit 92. In this way the exhaust duct 78 can be repeatedly removed and reinstalled on the clothes dryer 16 with relative ease. Additionally, the filter 62 associated with either of the first coupling unit 90 or the second coupling unit 92 can be removed and cleaned at any time. The second sleeve 74 can be attached directly to the exhaust vent 94 in the exterior wall 96 of the building 80 in the event that the exhaust vent 14 on the clothes dryer 16 can be precisely aligned with the exhaust vent 94 in the exterior wall 96.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dryer vent coupling assembly for quickly attaching an exhaust vent of a clothes dryer to an exhaust vent of a building, said assembly comprising:

a first sleeve having a diameter being sufficient to insertably receive an exhaust vent of a clothes dryer wherein said first sleeve is configured to receive heated air from said clothes dryer, said first sleeve having a set of first engagements and a set of second engagements;

a pair of gaskets, each of said gaskets being integrated into said first sleeve thereby facilitating each of said gaskets to engage said exhaust vent of said clothes dryer wherein said pair of gaskets is configured to inhibit air from leaking between said exhaust vent of said clothes dryer and said first sleeve;

a flange being attachable to said exhaust vent of said clothes dryer, said flange extending around said exhaust vent, said flange having a pair of primary engagements which each releasably engages a respective one of said first engagements on said first sleeve thereby releasably attaching said first sleeve to said clothes dryer;

a filter having a pair of secondary engagements which each releasably engages a respective one of said second engagements in said first sleeve for mounting said filter within said first sleeve wherein said filter is configured to filter lint from the heated air; and a second sleeve being insertable into said first sleeve when said filter is inserted into said first sleeve, said second sleeve having a pair of tertiary engagements which each releasably engage a respective one of said second engagements on said first sleeve for securing said second sleeve in said first sleeve, said second sleeve having a diameter being sufficient to extend into an exhaust duct of a building wherein said second sleeve is configured to direct the heated air into said exhaust duct for venting the heated air from said building.

2. The assembly according to claim 1, wherein:

said first sleeve has a first end, a second end and an outside wall extending between said first end and said second end, said outside wall having an inside surface and an outside surface; and said first sleeve has a pair of tabs each extending away from said outside surface at a point located adjacent to said first end such that said pair of tabs defines said set of first engagements, said tabs being positioned on opposing sides of said outside surface with respect to each other.

3. The assembly according to claim 2, wherein:

said flange has a forwardly facing surface being perpendicularly oriented with an inwardly facing surface;

said flange has a pair of primary slots each extending along said inwardly facing surface, said pair of primary slots being positioned on opposing sides of said inwardly facing surface with respect to each other;

said flange has a pair of secondary slots each extending into said forwardly facing surface and intersecting a respective one of said primary slots such that each of said primary slots and said secondary slots defines said respective primary engagement; and each of said tabs associated with said first sleeve is extendable into a respective one of said primary slots to position said flange around said first sleeve, said flange being rotatable such that each of said tabs travels into a respective one of said secondary slots thereby locking said flange on said first sleeve for securing said first sleeve to said clothes dryer.

4. The assembly according to claim 2, wherein:

said first sleeve has a pair of first grooves each extending into said inside surface of said outside wall, each of said first grooves extending from said second end of said first sleeve toward said first end of said first sleeve, said pair of first grooves being positioned on opposing sides of said inside surface with respect to each other; and said first sleeve has a pair of second grooves each extending into said inside surface of said outside wall, each of said second grooves being oriented to perpendicularly intersect a respective one of said first grooves such that each of said first grooves and said second grooves defines said set of second engagements, each of said second grooves being positioned closer to said second end of said first sleeve than a terminal end of said respective first groove.

5. The assembly according to claim 4, wherein said filter has a ring which has an outwardly facing surface, said ring having a pair of tabs each extending away from said outwardly facing surface, each of said tabs on said outwardly facing surface extending into a respective one of said first grooves in said inside surface of said outside wall of said first sleeve when said filter is inserted into said second end of said first sleeve, said filter being urged into said first sleeve such that each of said tabs on said outwardly facing surface abuts said terminal end of said respective first groove.

6. The assembly according to claim 4, wherein said second sleeve has a primary end, a secondary end and an outer surface extending between said primary end and said secondary end, said second sleeve having a pair of knobs each extending away from said outer surface, each of said knobs being positioned closer to said primary end than said secondary end, said knobs being positioned on opposing sides of said outer surface with respect to each other, each of said knobs extending into a respective one of said first grooves in said inside surface of said outside wall of said first sleeve when said primary end of said second sleeve is inserted into said second end of said first sleeve.

7. The assembly according to claim 6, wherein said second sleeve is rotatable to facilitate each of said knobs to travel into a respective one of said second grooves in said inside surface of said outside wall of said first sleeve for securing said second sleeve in said first sleeve having said ring associated with said filter being positioned between said primary end of said second sleeve and said lip on said inside surface of said outside wall of said first sleeve.

8. The assembly according to claim 2, wherein:

said first sleeve has a lip extending inwardly from said inside surface of said outside wall, said lip being positioned adjacent to said terminal end of said pair of first grooves;

each of said pair of gaskets forms a closed ring extending around said inside surface of said outside wall of said first sleeve, said pair of gaskets being evenly spaced apart from each other, said pair of gaskets being positioned between said lip and said first end of said first sleeve.

9. A dryer vent coupling assembly for quickly attaching an exhaust vent of a clothes dryer to an exhaust vent of a building, said assembly comprising:

a first sleeve having a diameter being sufficient to insertably receive an exhaust vent of a clothes dryer wherein said first sleeve is configured to receive heated air from said clothes dryer, said first sleeve having a set of first engagements and a set of second engagements, said first sleeve having a first end, a second end and an outside wall extending between said first end and said second end, said outside wall having an inside surface and an outside surface, said first sleeve having a pair of tabs each extending away from said outside surface at a point located adjacent to said first end such that said pair of tabs defines said set of first engagements, said tabs being positioned on opposing sides of said outside surface with respect to each other, said first sleeve having a pair of first grooves each extending into said inside surface of said outside wall, each of said first grooves extending from said second end of said first sleeve toward said first end of said first sleeve, said pair of first grooves being positioned on opposing sides of said inside surface with respect to each other, said first sleeve having a pair of second grooves each extending into said inside surface of said outside wall, each of said second grooves being oriented to perpendicularly intersect a respective one of said first grooves such that each of said first grooves and said second grooves defines said set of second engagements, each of said second grooves being positioned closer to said second end of said first sleeve than a terminal end of said respective first groove, said first sleeve having a lip extending inwardly from said inside surface of said outside wall, said lip being positioned adjacent to said terminal end of said pair of first grooves;

a pair of gaskets, each of said gaskets being integrated into said first sleeve thereby facilitating each of said gaskets to engage said exhaust vent of said clothes dryer wherein said pair of gaskets is configured to inhibit air from leaking between said exhaust vent of said clothes dryer and said first sleeve, each of said pair of gaskets forming a closed ring extending around said inside surface of said outside wall of said first sleeve, said pair of gaskets being evenly spaced apart from each other, said pair of gaskets being positioned between said lip and said first end of said first sleeve;

a flange being attachable to said exhaust vent of said clothes dryer, said flange extending around said exhaust vent, said flange having a pair of primary engagements which each releasably engages a respective one of said first engagements on said first sleeve thereby releasably attaching said first sleeve to said clothes dryer, said flange having a forwardly facing surface being perpendicularly oriented with an inwardly facing surface, said flange having a pair of primary slots each extending along said inwardly facing surface, said pair of primary slots being positioned on opposing sides of said inwardly facing surface with respect to each other, said flange having a pair of secondary slots each extending into said forwardly facing surface and intersecting a respective one of said primary slots such that each of said primary slots and said secondary slots defines said respective primary engagement, each of said tabs associated with said first sleeve being extendable into a respective one of said primary slots to position said flange around said first sleeve, said flange being rotatable such that each of said tabs travels into a respective one of said secondary slots thereby locking said flange on said first sleeve for securing said first sleeve to said clothes dryer;

a filter having a pair of secondary engagements which each releasably engages a respective one of said second engagements in said first sleeve for mounting said filter within said first sleeve wherein said filter is configured to filter lint from the heated air, said filter having a ring which has an outwardly facing surface, said ring having a pair of tabs each extending away from said outwardly facing surface, each of said tabs on said outwardly facing surface extending into a respective one of said first grooves in said inside surface of said outside wall of said first sleeve when said filter is inserted into said second end of said first sleeve, said filter being urged into said first sleeve such that each of said tabs on said outwardly facing surface abuts said terminal end of said respective first groove; and a second sleeve being insertable into said first sleeve when said filter is inserted into said first sleeve, said second sleeve having a pair of tertiary engagements which each releasably engage a respective one of said second engagements on said first sleeve for securing said second sleeve in said first sleeve, said second sleeve having a diameter being sufficient to extend into an exhaust duct of a building wherein said second sleeve is configured to direct the heated air into said exhaust duct for venting the heated air from said building, said second sleeve having a primary end, a secondary end and an outer surface extending between said primary end and said secondary end, said second sleeve having a pair of knobs each extending away from said outer surface, each of said knobs being positioned closer to said primary end than said secondary end, said knobs being positioned on opposing sides of said outer surface with respect to each other, each of said knobs extending into a respective one of said first grooves in said inside surface of said outside wall of said first sleeve when said primary end of said second sleeve is inserted into said second end of said first sleeve, said second sleeve being rotatable to facilitate each of said knobs to travel into a respective one of said second grooves in said inside surface of said outside wall of said first sleeve for securing said second sleeve in said first sleeve having said ring associated with said filter being positioned between said primary end of said second sleeve and said lip on said inside surface of said outside wall of said first sleeve.

* * * * *